United States Patent [19]

Ikeda et al.

BEST AVAILABLE COPY

[11] 4,454,979

[45] Jun. 19, 1984

[54] LAMINATED PACKING BAG WITH SPOUT FORMED FROM HANDLE PORTION

[75] Inventors: Masaomi Ikeda; Yotaro Tsutsumi, both of Yokohama, Japan

[73] Assignee: Toyo Seikan Kaisha Ltd., Tokyo, Japan

[21] Appl. No.: 296,057

[22] Filed: Aug. 25, 1981

[30] Foreign Application Priority Data

Sep. 5, 1980 [JP] Japan ..... 55-122217
Nov. 12, 1980 [JP] Japan ..... 55-160731[U]

[51] Int. Cl.[3] ..... B65D 5/46; B65D 5/72; B65D 5/70

[52] U.S. Cl. ..... 229/52 B; 229/52 A; 229/17 R; 229/3.5 MF; 206/626; 206/628; 383/104; 383/116; 383/904; 383/906

[58] Field of Search ..... 206/524.1, 524.2, 632, 206/626, 605, 628, 633; 224/906; 229/3.1, 3.5, 4.5, 5.5, 7 R, 48 T, 53, 52 R, 58, 52 B, 52 A, 61, 54, 57, 62.5

[56] References Cited

U.S. PATENT DOCUMENTS

| | | | |
|---|---|---|---|
| 2,378,503 | 6/1945 | Rohdin | 229/62 |
| 2,584,632 | 2/1952 | Southwick, Jr. | 229/5.5 |
| 2,789,728 | 4/1957 | Britton | 206/632 X |
| 2,802,565 | 8/1957 | Kabbash | 229/9 |
| 2,954,153 | 9/1960 | Bennett | 229/52 B |
| 3,208,661 | 9/1965 | Hewitt et al. | 229/62.5 |
| 3,339,820 | 9/1967 | Krzyzanowski | 206/633 |
| 3,343,743 | 9/1967 | Hamilton, Jr. et al. | 229/52 AC |
| 3,380,646 | 4/1968 | Doyen et al. | 229/53 |
| 3,381,885 | 5/1968 | Seiferth et al. | 229/53 |
| 3,642,189 | 2/1972 | Widenback | 229/7 R |
| 3,746,240 | 7/1973 | Flynn | 220/462 |
| 3,935,993 | 1/1974 | Doyen et al. | 229/53 |
| 3,980,225 | 9/1976 | Kan | 229/57 |
| 4,322,003 | 3/1982 | Long | 229/3.5 X |

FOREIGN PATENT DOCUMENTS

| | | | |
|---|---|---|---|
| 570955 | 9/1958 | Belgium | 229/57 |
| 2294093 | 8/1976 | France | 229/57 |

*Primary Examiner*—Steven M. Pollard
*Assistant Examiner*—Bryon P. Gehman
*Attorney, Agent, or Firm*—Wenderoth, Lind & Ponack

[57] ABSTRACT

A packing bag is formed by sealing longer side edges, and by sealing V shaped folded sheets to the shorter sides. A portion of the longer side edges is left unsealed to form an inlet port. A protected cylinder or handle may be attached to overlie the inlet port. Opposed notches are formed on both sides of the cylinder or handle to facilitate opening of the bag.

8 Claims, 13 Drawing Figures

LAMINATED PACKING BAG WITH SPOUT FORMED FROM HANDLE PORTION

BACKGROUND OF THE INVENTION

This invention relates to a laminated packing bag made of heat fusible sheets, preferably a lamination of a polyethylene or polypropylene sheet, an aluminum foil, and a polyester sheet, which are laminated in the order mentioned with the polyethylene or polypropylene sheet innermost, the bag being used to contain juice, milk, sauce or the like of a relatively large quantity suitable for a family or several persons.

In recent years a so-called retort pouch has been known. A retort pouch is a bag packed with a foodstuff wherein the bag is made of a lamination of a polyethylene or polypropylene sheet, an aluminum sheet and a polyester sheet with the polyethylene or polypropylene sheet as the innermost layer. Such pouches containing various types of foodstuffs are sold in markets.

With regard to beverages, the recent tendency is to have packing bags having a relatively large capacity for use by a family unit or a group unit. Usually, the bag is formed by preparing two rectangular laminated sheets of the type described above which are superposed one upon the other and by sealing the four sides of the superposed sheets by fusion, and the bag is filled with such content as juice of a quantity for several persons.

However, when the bag is filled, the four corners of the bag become sharp just like a cushion, so that the bag is not only inconvenient to convey but also has a less pleasing appearance. Moreover, where the volume of the content is large, there is a danger that the seal might rupture and the bag become bulky to carry. Further, where the content is a beverage, it is difficult to dispense.

SUMMARY OF THE INVENTION

Accordingly, it is an object of this invention to provide an improved laminated packing bag that can eliminate the disadvantages described above.

Another object of this invention is to provide an improved laminated packing bag which can stand upright so that it can be handled like a metal can.

According to this invention there is provided a packing bag comprising two superposed layers of heat fusible material, two folded sheets at opposite ends of the superposed layers, each folded sheet having a sectional configuration of a letter W, opposing side edges of the superposed layers being sealed along substantially the entire length thereof, edges of the folded sheets being sealed to respective layers, and, not sealed portions of the opposing side edges of the superposed layers forming an inlet port.

BRIEF DESCRIPTION OF THE DRAWINGS

Further objects and advantages can be more fully understood from the following detailed description taken with the accompanying drawings in which.

DESCRIPTION OF THE PREFERRED EMBODIMENTS

Typical preferred embodiments will now be described with reference to the accompanying drawings.

Figure 1:
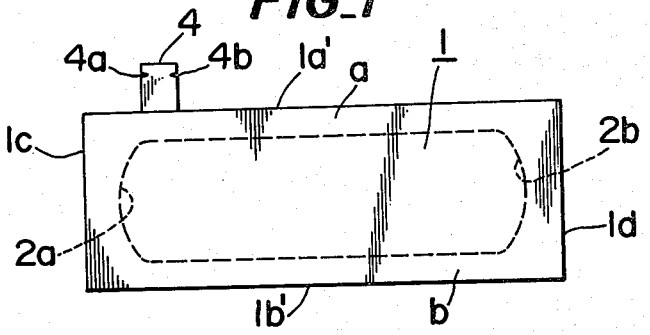
FIG. 1 is a front view showing one embodiment of the laminated bag embodying the invention.

A laminated sheet (side wall) 1 shown in FIG. 1 comprises a polyethylene or polypropylene sheet (used as an inner layer of a bag), an intermediate aluminum layer and an outer polyester sheet, and has a rectangular configuration.

A bag is prepared by overlapping two such sheets 1*a* and 1*b* and longer side edges 1*a*′ and 1*b*′ of the inner polyethylene sheets are fused together to form sealed side edges a and b. Opposite shorter side edges 1*c* and 1*d* of one laminated sheet 1 are provided with folded sheets 2*a* and 2*b* respectively to form ends which are each in the shape of a letter W.

Figure 2:
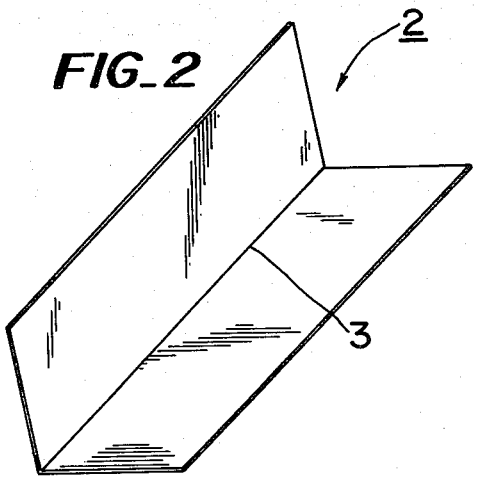
FIG. 2 is a perspective view showing a folded sheet utilized to manufacture the bag shown in FIG. 1.
Figure 3:
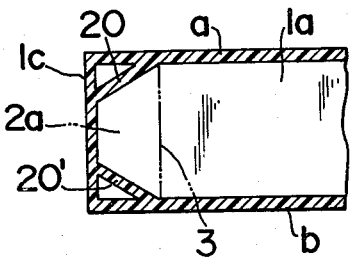
FIGS. 3 and 4 are sectional views showing the manner of sealing the folded sheet.
Figure 4:
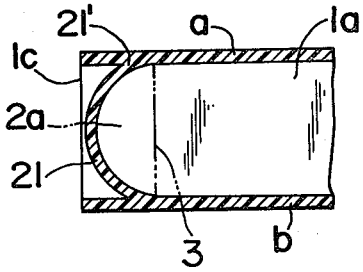

As shown in FIG. 2, a sheet 2 is folded into a letter V shape along the center line 3, and two such folded sheets (end walls) 2*a* and 2*b* are attached to shorter side edges 1*c* and 1*d* of the two laminated sheets or layers 1*a* and 1*b*. The folded sheets 2*a* and 2*b* are sealed in the following ways. In one example shown in FIG. 3, inclined sealing members 20 and 20′ are attached to the corners at the intersections between the sealed side edges a and b, and the folded sheet 2*a* comprising the shorter side edge 1*c*. Alternatively, the two sealing members 20 and 20′ may be combined into a single curved piece 21 as shown in FIG. 4.

As above described, since the edge portions of the folded sheets 2*a* and 2*b* are sealed to the laminated sheets 1*a* and 1*b* the sealed portions would be at higher levels than the end edges 1*e* and 1*f* of the shorter side edges 1*c* and 1*d* of two laminated sheets 1*a* and 1*b*. When the bag stands upright with the shorter side edge 1*c* or 1*d* at the bottom, the end edges 1*e* and 1*f* maintain the upright position of the bag.

The bag thus prepared is provided with a projection 4 forming an inlet port for charging or discharging a beverage, for example, at a predetermined position along the longer side edge 1*a*′ of the laminated sheet 1 other than a portion at which the one of the folded sheets 2*a* and 2*b* is folded, for example, at a portion near the shorter side edge 1*c*. The inlet port is for example formed by a small cylinder, and integrally formed with the laminated sheets 1. Notches 4*a* and 4*b* are provided near the sealed top of the inlet cylinder 4 so that when the sealed top is cut away along the notches 4*a* and 4*b*, the inlet port is opened. The maximum width of the inlet cylinder 4 may be equal to the length between the upper ends 21′ of the curved members 21 at both ends of the bag and the width can be selected to any value within this length. The height of the inlet cylinder 4 may take any desired value. For example, the height may be zero in which case a portion of the longer side edge 1a' may be left unsealed. Although there is no limit on the maximum height, it is determined to be a suitable value depending upon the application of the bag.

As above described, a bag is formed by fusing together the peripheries of the laminated sheets 1 and the folded sheet 2, and a content such as juice is poured into the bag through the inlet cylinder 4 and then the top of the inlet cylinder 4 is sealed.

Figure 5:
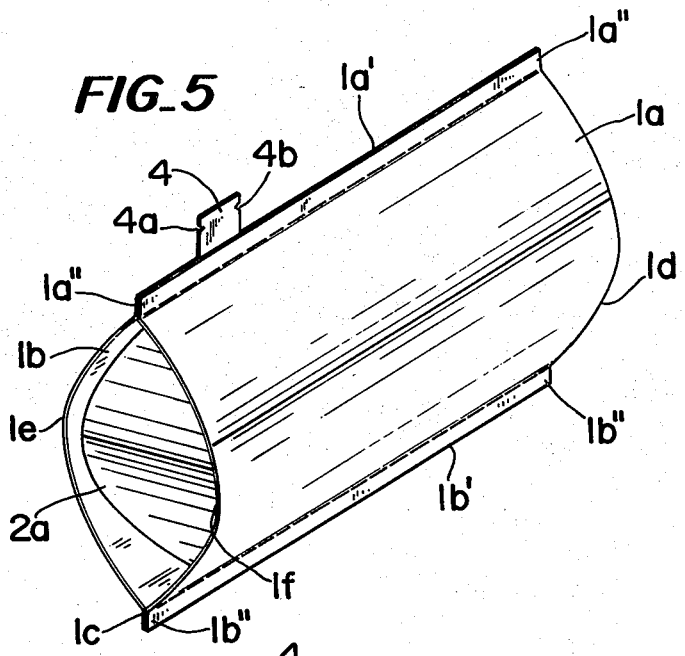
FIG. 5 is a perspective view of the bag filled with a beverage.

When filled, the bag will take the form of a pack as shown in FIG. 5 and can stand upright on the end edges 1e and 1f with the shorter edge 1c or 1d as the bottom just like a can. Accordingly, filled bags can be readily piled up or transported. For example, in FIG. 5, at the opposite ends 1a'' and 1b'' of the longer side edges, the upper and lower portions of the shorter side edges of two W shaped sheets are fused together. In other words, at these portions, a total of four layers are used (where the bag is formed with a single laminated sheet), and by making cylindrical the opposite ends of the bag including the folded portions, the bag can stand upright. If this property is not required it is not necessay to fuse together these portions.

When fusing portions together as above described, if the outermost layer is not heat fusible, a portion thereof is cut away to expose a portion of a heat fusible layer for effecting heat fusion.

To take out the contents of the bag, the inlet cylinder 4 is cut away at notches 4a and 4b to open the top of the bag. If the content is a beverage, a straw may be inserted, or the content may be poured into a cup or the like.

Figure 6:
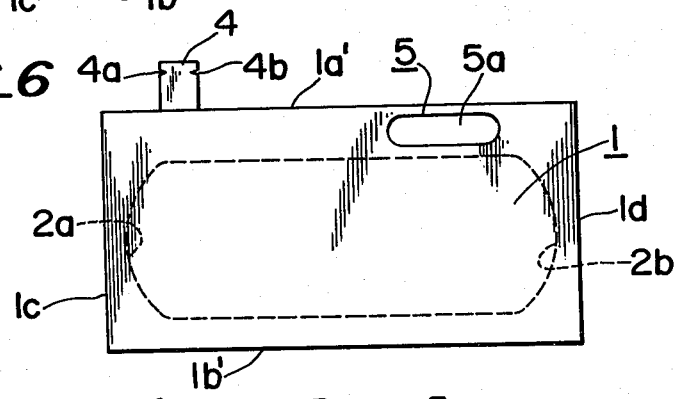
FIGS. 6 through 8 are front views showing other modifications of this invention.
Figure 7:
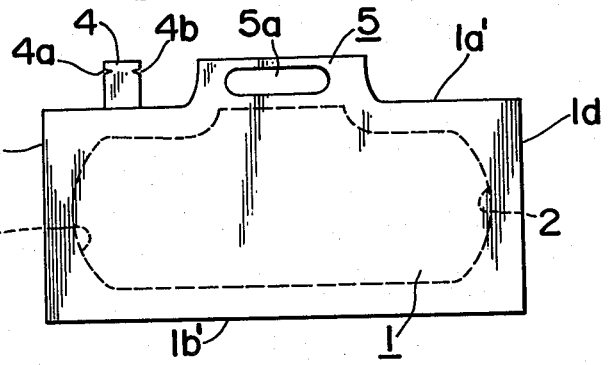
Figure 8:
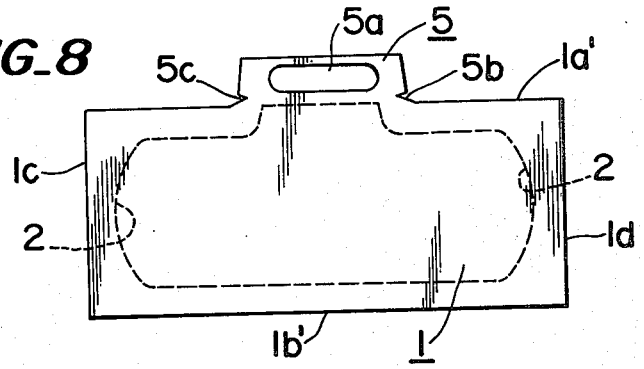

FIGS. 6, 7 and 8 illustrate other embodiments of the packing bag according to this invention. In the case shown in FIG. 6, at a portion of the longer side edge 1a' opposite to the inlet cylinder 4, a portion near the shorter side edge 1d is formed as a handle 5 by forming an elongated slot 5a.

The handle 5 not only makes it easy to transport the bag but also makes it easy to discharge of the contents because it is possible to incline the bag with the hand.

In the embodiment shown in FIG. 7, the handle 5 is integrally formed with the laminated sheet 1 projecting at the central portion of the longer side edge 1a.

In still another modification shown in FIG. 8, the handle 5 shown in FIG. 7 is formed with opposing notches 5b and 5c near the base portion thereof, thus eliminating the separate inlet port, and utilizing the handle as the inlet port. To permit pouring out of the contents, the handle 5 is cut away along the notches 5b and 5c.

In each embodiment, any other heat fusible materials or combinations thereof can be used for the laminated sheet and the folded sheet. After discharging the contents, the bag becomes perfectly flat and is not bulky, which eliminates the disadvantage of metal cans.

As above described, the inlet port may be formed by leaving a portion of one edge not fused. In this case the height of the inlet port is zero; that is, nothing projects beyond the side edge.

As above described, according to the packing bag of this invention, two laminated sheets are superposed, one pair of opposing side edges are fused together, and W shaped bent laminated sheets are interposed between the opposite side edges and then fused together to form a pack shaped bag. Accordingly, the bag is compact and can stand upright when filled. Moreover, filling and discharge of the contents are easy and handling of the empty and filled bag is also easy.

Figure 9:
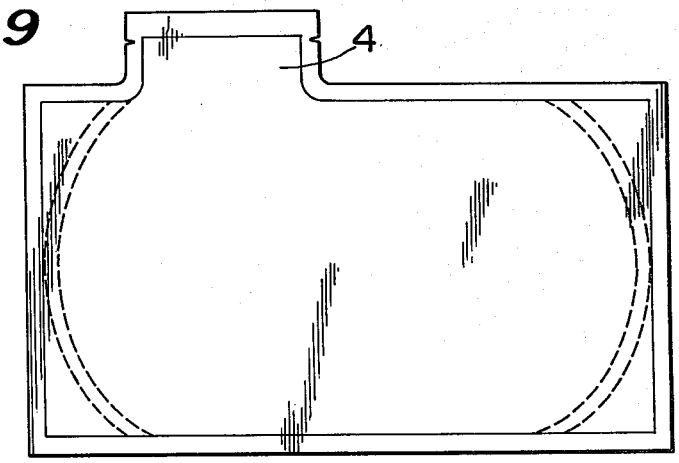
FIG. 9 is a front view showing still another modification of this invention in which the inlet port is located near one side.
Figure 10:
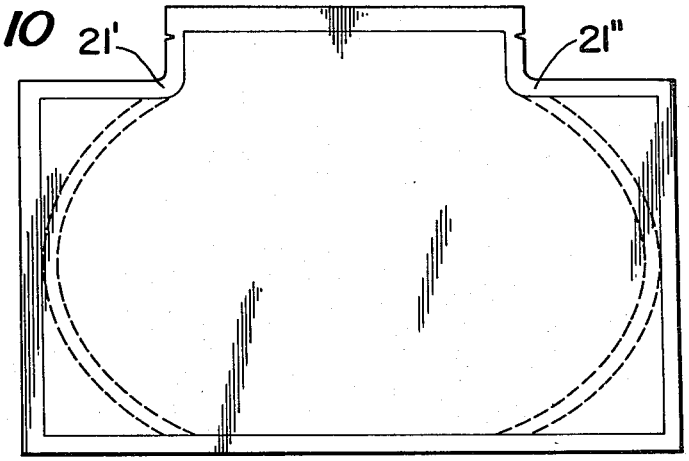
FIG. 10 is a front view showing a typical embodiment of the invention.

FIG. 10 shows the most typical embodiment of this invention, while FIG. 9 shows an example in which the inlet port is slightly displaced to the left from the center of the bag.

Figure 11:
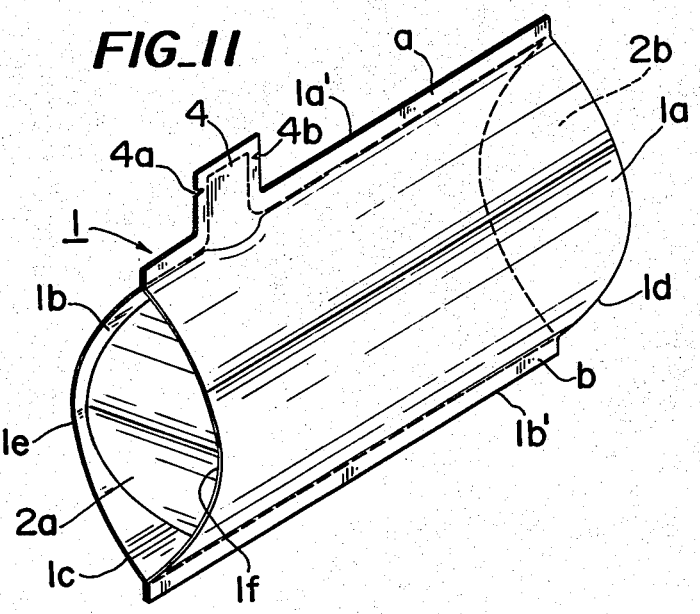
FIG. 11 is a perspective view showing a modified packing bag of this invention.
Figure 12:
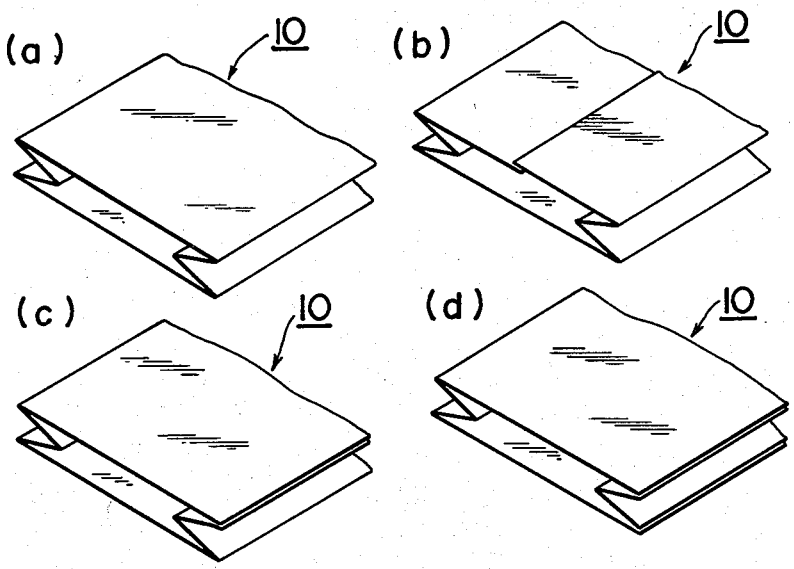
FIGS. 12(*a*), 12(*b*), 12(*c*) and 12(*d*) are perspective views showing different embodiments of a section of a bag body.

FIG. 11 shows a further modification of this invention in which parts corresponding to those shown in FIG. 1 are designated by the same reference characters. This is generally similar to that shown in FIG. 1 except that the folded sheet at one end of the bag is formed integral with the superposed laminated layers. More particularly, at one of the shorter side edges 1c and 1d, W shaped folds 2a and 2b are formed by folding an integral extension of the main body 1. These folds are also sealed to the both laminated layers in the same manner as shown in FIGS. 2 and 3.

In addition to the lamination comprising an inner polypropylene or polyethylene sheet, an intermediate aluminum foil and an outer polyester sheet described above, the following combinations can be used.

A. Three layer lamination:

| | Inner layer | Intermediate layer | Outer layer |
|---|---|---|---|
| 1. | Polypropylene or polyethylene | Aluminum foil | Polyester |
| 2. | Polypropylene or polyethylene | Aluminum foil | Nylon |
| 3. | Polypropylene or polyethylene | Aluminum foil | Elongated polypropylene or not-elongated polypropylene |
| 4. | Polypropylene or polyethylene | Eval | polyester |

B. Two layer lamination:

| | Inner layer | Outer layer |
|---|---|---|
| 1. | Polyethylene or polypropylene | Cellophane |
| 2. | Polyethylene | Polyethylene |
| 3. | Polypropylene | Polypropylene |

C. Single layer sheet:

Polyethylene, polypropylene, cellophane, polyester, etc.

D. Four layer lamination:

Inner layer: polyethylene or polypropylene,

Intermediate layers: aluminum and nylon,

Outer layer: polyester.

The body 10 of a bag may be formed as shown in FIG. 4 in which upper and lower flat portions are interconnected by W shaped side ends. The top and bottom ends are formed as shown in FIG. 1 or 11.

The section 10 shown in FIGS. 12(a), 12(b), 12(c) or 12(d) may be formed of a tubular or cylindrical sheet, or may be prepared by bonding together opposite ends of a sheet at any suitable position, for example along one outer edge of the W.

Figure 13:
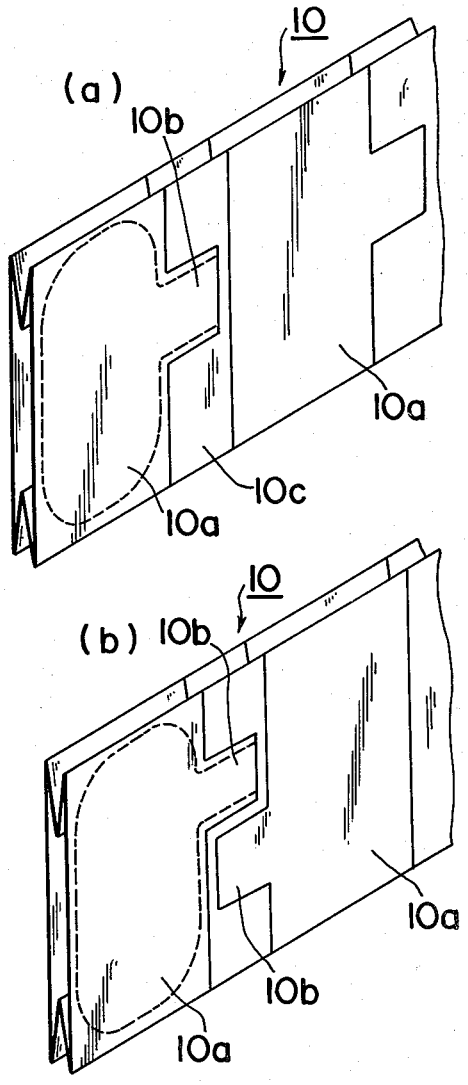
FIGS. 13(*a*) and 13(*b*) are perspective views showing a method of cutting bag bodies out of a continuous web.

When forming sections 10a and 10b utilized to prepare bags with inlet portions 10b, it is advantageous to cut the sections 10a as shown in FIGS. 3(a) and 13(b) with the inlet portions 10b staggered for the purpose of minimizing loss of raw material.

What is claimed is:

1. A free-standing manually portable container for carrying liquid, comprising:

a pair of coextensive heat fusible flexible side walls formed from integral sheets, each having opposite longitudinally extending side edges and opposite laterally extending side edges, said side walls being heat sealed face-to-face along said longitudinally extending side edges except along a continuous segment thereof, to form longitudinally extending sealed portions, said side walls having coextensive laterally outwardly extending projections projecting from said longitudinally extending side edges at said continuous segment sealed along the laterally outer edges thereof to form sealed projection edges;

a pair of end walls connected along their edges to said side walls adjacent said laterally extending side edges so as to fold inwardly at opposite longitudinal ends of said side walls between said side walls along a central laterally extending fold line when said side walls are flattened against each other, said side walls and end walls forming an enclosure which may be filled with liquid; and non-straight seams connecting each of said end walls to each of said side walls such that said side walls become outwardly convex all along their longitudinal extent when said enclosure is filled with a liquid, said seams and longitudinally extending sealed portions providing sufficient rigidity to said container so that said container is self-supporting so as to stand freely on either of said longitudinal ends when said enclosure is filled with liquid;

a longitudinally elongated slot extending transversely through both of said projections of said pair of side walls between said sealed projection edges and said continuous segment so as to form a handle for carrying said container, said projection being sealed along the boundaries of said slot and having at least one notch between said slot and said continuous segment to facilitate removing said projections from said side walls so as to expose said continuous segment, whereby said continuous segment serves as an opening for pouring said liquid from said enclosure.

2. A container as in claim 1, wherein each of said end walls opens into a trapezoidally shaped sheet on each side of said fold line when said enclosure is filled with liquid.

3. A container as in claim 1, wherein each of said end walls opens into a hemispherically shaped sheet on each side of said fold line when said encloure is filled with liquid.

4. A container as in claim 1, wherein each of said sidewalls and each of said end walls comprises a lamination of an inner layer, an outer layer and a middle layer between said inner and outer layers, said inner layer substantially consisting of polypropylene and polyethylene, said middle layer comprising an aluminum sheet and said outer layer comprising a polyester sheet.

5. A container as in claim 1, wherein each of said end walls comprises an outer layer of nonfusible material and an inner layer of fusible material, a portion of said outer layer being removed to expose said inner layer at each of said nonstraight seams.

6. A container as in claim 1, wherein one of said end walls is integrally formed with one of said side walls.

7. A container as in claim 1, wherein said pair of end walls and said pair of side walls are integrally formed from a continuous sheet.

8. A container as in claim 1, wherein said continuous segment of said longitudinally extending side edges and said longitudinally elongated slot are located substantially equidistant from said laterally extending side edges.

* * * * *